United States Patent [19]

Smith

[11] 4,405,303

[45] Sep. 20, 1983

[54] PORTABLE RECREATIONAL MARKER BUOY

[76] Inventor: Richard K. Smith, 7066 Carey La., Maple Grove, Minn. 55369

[21] Appl. No.: 297,134

[22] Filed: Aug. 28, 1981

[51] Int. Cl.[3] ..... B63B 21/52

[52] U.S. Cl. ..... 441/16; 441/22; 441/25

[58] Field of Search ..... 441/6, 11, 13, 16, 21, 441/22, 23, 24, 133, 25, 28

[56] References Cited

U.S. PATENT DOCUMENTS

| | | | |
|---|---|---|---|
| 512,957 | 1/1894 | Guest et al. . | |
| 2,088,201 | 7/1937 | Goertzen . | |
| 2,366,929 | 1/1945 | Pfeil | 441/16 |
| 2,527,956 | 10/1950 | Peevey | 441/16 |
| 2,977,608 | 4/1961 | Brown, Sr. et al. . | |
| 3,036,397 | 5/1962 | Canada, Sr. | 441/23 |
| 3,037,217 | 6/1962 | Mandra . | |
| 3,441,962 | 5/1969 | Williams . | |
| 3,500,783 | 3/1970 | Johnson, Jr. et al. | 441/23 |
| 3,653,085 | 4/1972 | Rovner . | |
| 3,827,093 | 8/1974 | Davis . | |
| 3,935,658 | 2/1976 | Simpson . | |
| 4,048,677 | 9/1977 | Kajlich . | |
| 4,103,379 | 8/1978 | Wolfe . | |

*Primary Examiner*—Sherman D. Basinger
*Attorney, Agent, or Firm*—Merchant, Gould, Smith, Edell, Welter & Schmidt

[57] ABSTRACT

A portable self-setting marker buoy (10) comprises an elongate float body (12) having a pair of spherical end portions (14) secured to opposite ends of a tubular intermediate portion (16), to which one end of a line (20) is attached. A sinker (24) is attached to the other end of the line (20). Laterally projecting paddles (18) stabilize the body (12) to minimize drifting of the buoy after it has been thrown into the water and the line (20) unwinds as the sinker (24) hits bottom. An internal battery operated light source (26) is preferably included for illuminating the buoy during periods of low visibility or darkness.

9 Claims, 5 Drawing Figures

FIG. 1
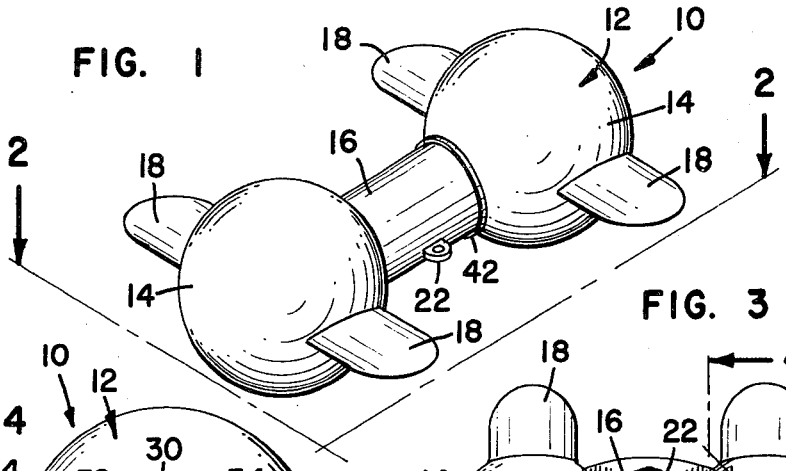
FIG. 3
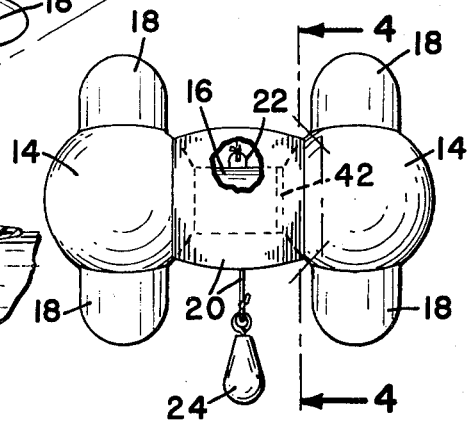
FIG. 4
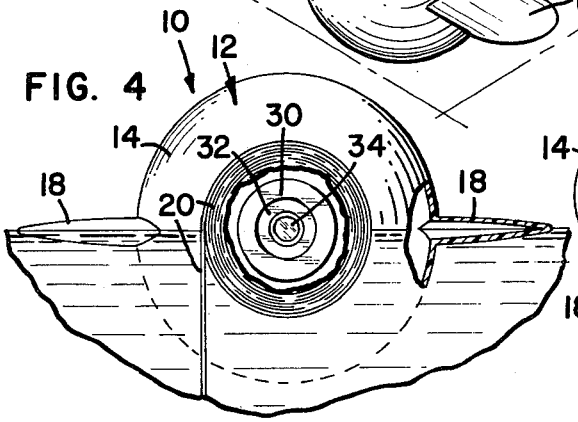
FIG. 2
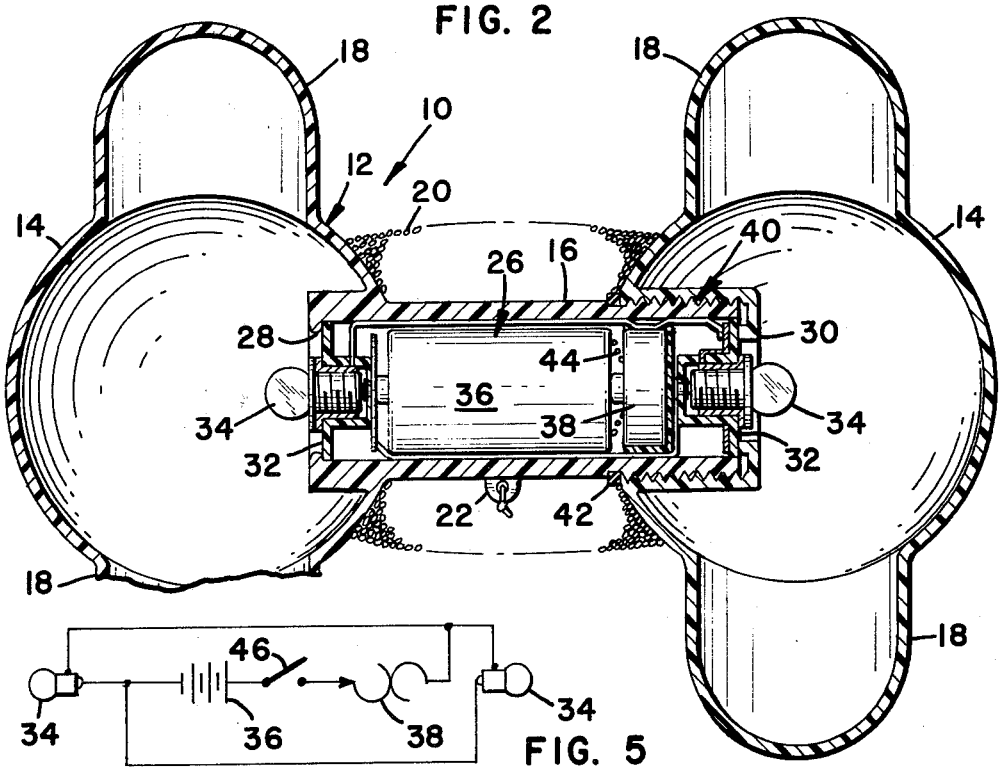
FIG. 5

PORTABLE RECREATIONAL MARKER BUOY

TECHNICAL FIELD

The present invention relates generally to a marine buoy, and more particularly to a self-setting marker buoy having a self-contained internal illumination source to facilitate use at night as well as during the daytime.

BACKGROUND ART

Various marker buoys have been utilized hereinbefore for marking reefs, channels, fishing spots, boating lanes and the like. Such buoys generally consist of a float secured to the end of a line which in turn is attached to a sinker weight, and generally fall into two categories. Simple buoys are most useful in spots where the water depth approximates the length of the line because drifting of the buoy is minimized. Self-setting buoys, on the other hand, are adaptive in that some means is employed for limiting payout of the line in relation to the depth at a particular spot. The self-setting marker buoys are therefore more desirable because they can be used in a wide range of water depths without significant drifting.

Various self-setting marker buoys have been available heretofore, but the buoys of the prior art have suffered from various drawbacks and difficulties. A common approach has been to wind the line around a flat body configured to rotate when tossed into the water thereby allowing payout of the line until the weight hits the bottom. The problem, however, is how to construct a float body which will not allow additional payout of the line after the weight hits bottom, and which is stable and not unduly susceptible to the action of wind and waves. For example, U.S. Pat. No. 2,977,608 to Brown discloses a self-setting marker buoy wherein the stabilizing action is provided by a waisted float body of rectangular cross-section and relatively large external area which tends to make the buoy more susceptible to wave action. U.S. Pat. No. 3,653,085 to Rovner shows a self-setting marker buoy having a dumbbell-shaped float body of circular cross-section which incorporates eccentric weights for ballast, and is therefore of relatively complicated and costly construction. Another problem comprises the fact that there has not been available heretofore a self-setting marker buoy having an internal source of illumination which facilitates usage at night or under conditions of poor visibility.

A need thus exists for an improved self-setting marker buoy which overcomes the foregoing and other difficulties associated with the prior devices.

SUMMARY OF INVENTION

In accordance with the invention, there is provided a self-setting marker buoy including an elongate body comprised of a pair of generally spherical float members secured to opposite ends of a reduced intermediate member of cylindrical section. A length of line is wrapped around the intermediate portion of the body and secured thereto at one end. A sinker weight is attached to the other end of the line. The float body further includes a pair of paddles projecting from opposite sides of each float member to assure controlled payout of the line as the weight sinks to the bottom after the buoy is thrown into the water at a desired spot. The buoy herein further includes a lamp disposed within each float member together with appropriate circuitry and a self-contained power source housed within the intermediate body for illuminating the buoy.

BRIEF DESCRIPTION OF DRAWING

A better understanding of the invention can be had by reference to the following Detailed Description in conjunction with the accompanying Drawing, wherein:

FIG. 1 is a perspective view of the portable recreational marker buoy incorporating the invention;

FIG. 2 is an enlarged partial cross-sectional view taken along lines 2—2 of FIG. 1 in the direction of the arrows;

FIG. 3 is a side view of the invention showing the line wound around the intermediate member of the float body;

FIG. 4 is an enlarged sectional view taken along lines 4—4 of FIG. 3 in the direction of the arrows showing the invention floating on water; and FIG. 5 is a schematic diagram of the lighting circuit of the invention.

DETAILED DESCRIPTION

Referring now to the drawing, wherein like reference numerals designate like or corresponding components throughout the views, and particularly referring to FIG. 1, there is shown a portable marker buoy 10 incorporating the invention. The marker buoy 10 comprises a generally elongate body 12 resembling a dumbbell in shape. The body 12, which can be formed of molded plastic, is defined by a pair of spherical hollow spaced-apart floatation members 14 interconnected by a hollow cylindrical intermediate member 16. At least two fins or paddles 18 are provided on each end portion 14 of body 12. The paddles 18 are arranged in oppositely extending coplanar pairs and function both to counteract uncontrolled payout of a sinker line (not shown in FIG. 1) and to stablize the buoy in the water after setting, as will be more fully explained hereinbelow.

FIGS. 2, 3 and 4 illustrate further structural details of the marker buoy 10. A line 20 is wound around the intermediate portion 16 of body 12 with one end of the line being securely attached to the body portion. As illustrated, one end of line 20 is secured to a tab 22 provided on the intermediate body portion 16; however, the use of a tab is not critical to practice of the invention and it will be appreciated that any suitable type of connection can be utilized. The free end of line 20 is secured to a sinker 24 shown in FIG. 3. Of course, sinker 24 is sized to rotate buoy 10 after it is tossed into the water such that line 20 can unwind thereby allowing the sinker to fall to the bottom. After sinker 24 hits the bottom, paddles 18 function to stabilize body 12 against further rotation so that the buoy 10 will not substantially drift from the designated site. As is best seen in FIG. 4, the paddles 18 are at least partially submerged after payout of line 20 such that only rounded surfaces of buoy 10 are exposed to the wind, thereby minimizing drag and the possibility of drifting.

Referring now to FIGS. 2 and 5, the preferred embodiment of the marker buoy 10 herein includes an internal light source 26 housed within body 12 for selectively illuminating the buoy during periods of darkness or low visibility. For this reason, the end portions 14 are preferably translucent. The light source 26 is housed within the intermediate body portion 16, retained between a lip 28 formed on one end portion 14 and another lip 30 formed on the opposite end portion. A bulb holder or socket 32 is provided at either end of light source 26 with bulbs 34 being seated in the sockets and protruding within the hollow interior of end portions 14. Bulbs 34 are connected in parallel to a battery 36 and a conventional flasher unit 38 which energizes the bulbs on an intermittent basis. Capacitative discharge devices suitable for use as flasher unit 38 are readily available from several commercial sources.

The preferred embodiment of the marker buoy 10 further includes a threaded connection 40 for removably securing one end portion 14 of body 12 to the intermediate portion 16. As illustrated, the male threads are provided on the intermediate body portion 16 and the female threads are provided on the corresponding end portion 14. For sealing purposes, a water-tight circumferential gasket 42 is provided between adjoining surfaces of the intermediate body portion 16 and the removable end portion 14. In addition, a spring 44 located between battery 36 and flasher unit 38 functions as the switch 46 in the schematic of FIG. 5 for the light source 26 by normally urging the battery and flasher unit apart, thereby opening the circuit. Light source 26 is activated simply by turning the removable end portion 14 down against spring 44 until contact is made between battery 36 and the flasher unit 38. If desired, the flasher unit 38 can be omitted from light source 26 so that bulbs 34 will be continuously illuminated once switched on.

From the foregoing, it will be apparent that the present invention comprises an improved portable recreational marker buoy having several advantages over the prior art. The invention incorporates oppositely projecting paddles in combination with generally spherical float members for stabilization. This provides sufficient resistance to prevent uncontrolled payout of the line interconnecting the sinker and buoy, while avoiding undue susceptibility to wind and water action which would cause further payout and drifting of the buoy. Another advantage involves the fact that the buoy incorporates a self-contained light source to facilitate location during times of low visibility or darkness. Other advantages will be evident to those skilled in the art.

Although particular embodiments of the invention have been illustrated in the accompanying Drawing and described in the preceding Detailed Description, it will be understood that the invention is not limited to the embodiments disclosed, but is intended to embrace any alternatives, modifications, and rearrangements of elements falling within the scope of the invention as defined by the following claims.

I claim:

1. A portable recreational marker buoy, comprising:

an elongate substantially symmetrical float body including a pair of spaced-apart hollow spherical end portions interconnected by a reduced intermediate tubular portion, one of the end portions being threaded onto the intermediate portion of said body;

a seal disposed between ajoining surfaces of the removable end portion and the intermediate portion of said body;

a pair of laterally extending paddles secured to each end portion of said body, said paddles being substantially coplanar;

a flexible line having two ends, said line being helically wound around and secured at one end to the intermediate portion of said body;

a sinker secured to the other end of said line, said sinker being of sufficient weight to rotate said body and paddles thereon in water to unreel said line until said sinker hits bottom;

a pair of bulbs located at opposite ends of the intermediate portion and extending into the end portions of said body;

a battery housed within the intermediate portion of said body; and circuit means for selectively connecting said battery and bulbs to illuminate the buoy.

2. The marker buoy of claim 1, wherein said body and paddles are formed of molded plastic with at least portions of said body being translucent.

3. The portable marker of claim 1, wherein said circuit means comprises:

a flasher unit for intermittently energizing said bulbs; and spring means for normally urging said battery and flasher unit out of contact.

4. A marker buoy, comprising:

an elongate float body having a pair of spaced-apart hollow spherical end portions interconnected by a reduced intermediate portion;

a pair of laterally extending paddles secured to each end portion of said body;

a line having two ends, said line being wound about and secured at one end to the intermediate portion of said body;

a sinker attached to the other end of said line, said sinker being of sufficient weight to rotate said body and paddles thereon in water to unwind said line until said sinker hits bottom;

bulbs located at opposite ends of the intermediate portion and extending into the end portions of said body;

a battery housed within the intermediate portion of said body;

a flasher unit housed within the intermediate portion of said body; and circuit means for selectively connecting said battery and flasher unit to said bulbs.

5. The marker buoy of claim 4, wherein said body and paddles are formed of molded plastic with at least portions of said body being translucent.

6. The marker buoy of claim 4, wherein an end portion of said body is removably secured to the intermediate portion, and further including:

a seal located between ajoining surfaces of the removable end portion and intermediate portion of said body.

7. The marker buoy of claim 4, further including:

a tab secured to the intermediate portion of said body, said one end of said line being secured to said tab.

8. A portable marker buoy, which comprises:

an elongate float body having a pair of spaced-apart hollow spherical end portions interconnected by a reduced intermediate portion;

one end portion of said body being threadedly secured to the intermediate portion thereof for internal access to said body;

a seal disposed between adjoining surfaces of the threadedly secured end portion and intermediate portion of said body;

a pair of laterally extending paddles secured to each end portion of said body, said paddles being substantially coplanar;

a flexible line having two ends, said line being helically wound about and secured at one end to the intermediate portion of said body;

a sinker attached to the other end of said line, said sinker being of sufficient weight to rotate said body and said paddles therewith in water to unwind said line until said sinker hits bottom;

bulbs located at opposite ends of the intermediate portion and extending into the end portion of said body;

a battery housed within the intermediate portion of said body;

a flasher unit housed within the intermediate portion of said body; and circuit means for selectively connecting said battery and flasher unit to said bulbs.

9. The marker buoy of claim 8, wherein said body and paddles are formed of molded plastic with at least portions of said buoy being translucent.

* * * * *